US007736208B2

(12) United States Patent
Bonis et al.

(10) Patent No.: US 7,736,208 B2
(45) Date of Patent: Jun. 15, 2010

(54) AMPHIBIOUS SHOE AND METHOD OF USE

(76) Inventors: Carrie L. Bonis, P.O. Box 100, Martinsville, NJ (US) 08836; Kostanteno Bonis, P.O. Box 100, Martinsville, NJ (US) 08836

( * ) Notice: Subject to any disclaimer, the term of this patent is extended or adjusted under 35 U.S.C. 154(b) by 0 days.

(21) Appl. No.: 12/005,858

(22) Filed: Dec. 28, 2007

(65) Prior Publication Data

US 2009/0170388 A1 Jul. 2, 2009

(51) Int. Cl.
*A63B 31/08* (2006.01)

(52) U.S. Cl. ..... 441/64

(58) Field of Classification Search ..... 441/61–64; D21/806

See application file for complete search history.

(56) References Cited

U.S. PATENT DOCUMENTS

| | | | | |
|---|---|---|---|---|
| 1,533,659 | A * | 4/1925 | Nilsson | 441/60 |
| 1,627,521 | A | 5/1927 | Menschel | 441/61 |
| 1,688,498 | A | 10/1928 | Jacobsen | 441/62 |
| 1,702,681 | A | 2/1929 | Barbosa | 441/62 |
| 2,980,926 | A | 4/1961 | Wolshin | 441/64 |
| 4,250,584 | A | 2/1981 | Korn | 441/61 |
| 4,599,071 | A | 7/1986 | Juang | 441/64 |
| 4,752,259 | A | 6/1988 | Tackett et al. | 441/64 |
| 5,041,039 | A | 8/1991 | Chang | 441/64 |
| 5,108,327 | A | 4/1992 | Klein | 441/62 |
| 5,429,536 | A * | 7/1995 | Evans | 441/64 |
| 5,447,457 | A | 9/1995 | Kamitani | 441/64 |
| 5,879,212 | A | 3/1999 | Kennedy | 441/64 |
| 5,924,902 | A | 7/1999 | Burns et al. | 441/64 |
| 6,155,898 | A | 12/2000 | Burns et al. | 441/64 |
| 6,247,982 | B1 | 6/2001 | Walker | 441/64 |
| 6,540,574 | B2 | 4/2003 | Hashizume et al. | 441/64 |
| 6,543,097 | B2 * | 4/2003 | Burt et al. | 24/170 |
| 7,159,336 | B2 | 1/2007 | Burns et al. | 36/8.1 |

FOREIGN PATENT DOCUMENTS

| | | |
|---|---|---|
| FR | 2565498 | 12/1985 |

* cited by examiner

*Primary Examiner*—Ed Swinehart
(74) *Attorney, Agent, or Firm*—Ernest D. Buff & Associates, LLC.; Ernest D. Buff; Margaret A. LaCroix

(57) ABSTRACT

An amphibious shoe has a sole with a fin compartment therein. The fin compartment provides retractable housing for a lightweight fin for conversion from a walking to swimming shoe. In one embodiment the amphibious shoe includes a fin comprising a plurality of ridges. The ridges are intermittently disposed between material arranged in an accordion construction. When ejected from the compartment, the ridged material expands to a fan configuration. The fan is further appointed with a pivotal stabilizing strap for enhanced stability during swimming. In another embodiment the amphibious shoe includes at least two fin plates pivotally attached about an axis. The fin plates are stowed in an overlapping condition. They are capable of being ejected from the compartment and opposingly rotated toward the front of the shoe abutting to form a swim fin. In operation, the wearer can comfortably run or walk swiftly along the land as the integrated fin has a thin lightweight construction. Upon reaching the water's edge, the shoe is readily converted for swimming by ejecting and positioning the fin.

13 Claims, 8 Drawing Sheets

AMPHIBIOUS SHOE AND METHOD OF USE

BACKGROUND OF THE INVENTION

1. Field of the Invention

The present invention relates to an amphibious shoe for swimming and walking; and more particularly, to an amphibious shoe having a sole with a fin compartment adapted to retractably house a lightweight fin enabling conversion from a walking to a swimming shoe.

2. Description of the Prior Art

Increased propulsion and maneuverability in water during diving, swimming, and snorkeling is typically achieved by utilizing fins. However, donning fins on land and then walking into the water presents difficulties that oftentimes cause the wearer to trip and fall. Even still, carrying fins onto the beach or to the water's edge can be cumbersome, especially if other items are also needed to be hauled.

Amphibious shoe devices have been provided that utilize a separate mountable fin appointed to be removably attached to a shoe for swimming. Mountable fin devices pose significant problems, including time consuming attachment processes and burdensome carrying of the flipper. During walking, debris will easily lodge into screw holes, or other attachment means, clogging or damaging same so that attachment of a fin would become further aggravating, if not impossible. For example, U.S. Pat. No. 5,041,039 to Chang discloses an amphibious shoe including a shoe having a fastening plate at its front end for connection to a diving flipper.

Several swim shoes have been provided that utilize a rotatable fin attached or mounted on an exterior portion of a shoe construct. These external foldable fins, propellers, or blades are hingedly or bendabley attached to the exterior of the shoe in a vertical orientation for walking and rotated to a horizontal orientation for swimming. External positioning of the fin structure exposes the rotatable fin to damage and poses tripping problems as the fin readily snags on objects as the wearer is walking. Further, the external fin mounted on the shoe causes the shoe to appear aesthetically gaudy if the wearer exits the beach to walk on the boardwalk, or other proximate locations. For example: U.S. Pat. No. 1,627,521 to Menschel discloses a shoe having a laterally pivoting aluminum frame; U.S. Pat. No. 1,702,681 to Barbosa discloses a sandal/shoe with a blade structure hingedly attached to the side of the shoe; U.S. Pat. No. 4,250,584 to Korn discloses a collapsible swim fin; U.S. Pat. No. 4,752,259 to Tackett et al. discloses a rotatable two-part fin; U.S. Pat. No. 5,108,327 to Klein discloses a retractable rotating swim fin; U.S. Pat. No. 5,447,457 to Kamitani discloses a pivoting swim fin; U.S. Pat. No. 5,879,212 to Kennedy discloses a rotatable blade (swim fin); U.S. Pat. No. 5,924,902 to Burns et al. discloses a shoe-like structure fused to a foldable one-piece continuous sole-fin; U.S. Pat. No. 6,155,898 to Burns et al. discloses a fin blade that rests adjacent to a wearer's instep; U.S. Pat. No. 6,247,982 to Walker discloses a rotatable fin; U.S. Pat. No. 6,540,574 to Hashizume et al. discloses a foldable diving flipper; U.S. Pat. No. 7,159,336 to Burns et al. discloses an improved amphibious shoe with a folding swim fin; and Foreign Publication No. FR 2565498 A1 to Vielle discloses a sandal having a rotatable flexible paddle.

Various swim shoes have been provided wherein a pivoting propeller or swim blade is laterally integrated within the heel or back of the sole of a shoe. These propellers or blades generally operate to pivot from an axis located in the heel of the shoe so that the blades do not act as fins in the front of the shoe, but instead engage as propeller blades on either side of the back of the shoe. When deployed, the propeller blades do not act as a fin construct as there are spaces between the blades, which are not as effective as a fin during swimming. For example: U.S. Pat. No. 1,688,498 to Jacobsen discloses a swimming shoe wherein a device having pivoting propeller blades is appointed to be attached to the soles of a shoe so that propeller blades pivot outwardly from the heel of the shoe to operate as pedals.

Even where swim shoes have been provided with swimming propellers, fins or blade integrated within a cavity stowed in the front portion of a sole of a shoe, these swim shoes fail to provide stabilization means that operate in conjunction with the fin to prevent buckling of the fin or loss of the shoe during swimming. The frontward integrated swim shoes heretofore disclosed and utilized are generally constructed as sandals with instep straps, toe straps, and a heel strap with a retractable fin, failing to provide enhanced stabilization means during swimming. Other disclosed embodiments only provide a clog-like shoe structure, lacking heel supports altogether. For examples: U.S. Pat. No. 2,980,926 to Wolshin discloses a swimming appliance or fin shoe that contemplates a shoe similar to a beach sandal which is provided with an extensible fin having a plurality of relatively flexible ribs connected by integral flexible webbing which expands when pulled forward from the shoe and contracts when pulled back into the shoe; U.S. Pat. No. 4,599,071 to Juang discloses an adjustable beach shoe having a platform and straps, as a sandal, wherein peripheral walls of the platform are formed with a first cut-out on the front end for admitting a web to pass through, so that when the web is pulled out and held between the sole and the platform at the front end of the platform, the shoes can be used as a diving flipper; and Foreign Publication No. SU 995825 to Berman et al. discloses footwear for swimming including a shoe portion having a fin housed therein.

None of the water-land shoes heretofore disclosed provides a show having a sole with a compartment therein for housing a fin or fin forming blade structure, which further provides enhanced stabilization means for comfort and securement of the shoe during swimming. Such a construct would provide an amphibious shoe that can readily be manipulated from a walking configuration to a swimming configuration, while activating stabilization means for providing enhanced stability of the shoe during swimming.

There remains a need in the art for an amphibious shoe having a lightweight fin portion internally integrated therein for immediate access enabling conversion from a walking shoe to a swimming shoe. Further needed is an amphibious shoe having enhanced stabilizing means integrated therein for superior operation of the fin and stabilization of the shoe during swimming as water is propelled to-and-fro against the fin.

SUMMARY OF THE INVENTION

The present invention provides an amphibious shoe having a lightweight fin portion internally integrated therein for immediate access for conversion from a walking shoe to a swimming shoe. The amphibious shoe is further provided with enhanced stabilizing means integrated therein for superior operation of the fin and stabilization of the shoe during swimming as water is propelled to-and-fro against the fin. The amphibious shoe's construction functions to require minimal manipulation of the shoe, so that the wearer does not have to remove the shoe or carry any obtuse fin parts.

In a first embodiment, the amphibious shoe comprises a shoe having a sole including a fin aperture, top wall, back wall, and a bottom wall constructed to form a fin compartment integrated therein. A fin is housed within the fin compartment in a retracted position. The fin is associated with a release button in communication with a spring that forces a portion of the fin from the fin compartment through the fin aperture of the sole in an ejected position. A plurality of ridges, disposed intermittently between a material sheet of the fin, are arranged in an accordion construction so that the fin is capable of being expanded to a fan configuration. Compression of the fin in the fan configuration reduces the fin to a compact configuration when the fin is appointed to be retracted back into the fin compartment in the sole. A pivotal stabilizing strap assembly is further attached to the shoe, and is appointed for holding the fin in place on a wearer's foot. This pivotal stabilizing strap operates to pivot and rest against the wearer's foot to provide enhanced stability of the fin and shoe during swimming.

In a second embodiment, the amphibious shoe comprises a shoe appointed with a front toe area, arch area, and a heel area, wherein the shoe has a sole including an elongated lateral fin opening, top wall, back wall, and a bottom wall constructed to form a fin compartment longitudinally integrated within the sole. At least two fin plates attached by way of an axis extending between the top wall and the bottom wall of the sole located within the toe area of the shoe are provided. These fin plates are housed in an overlapping condition within the fin compartment in a retracted position and are appointed to opposingly pivot and rotate through the elongated lateral fin opening toward the toe area of the shoe until they abut to form a swim fin.

A method of using an amphibious shoe is provided. The method includes the steps of: (i) wearing a shoe appointed with a front toe area, arch area, and a heel area, the shoe having a sole including an elongated lateral fin opening, top wall, back wall, and a bottom wall constructed to form a fin compartment longitudinally integrated therein; (ii) adjusting the shoe for swimming by rotating at least two fin plates from the fin compartment longitudinally integrated within the sole through the elongated lateral fin opening, the fin plates being attached by way of an axis extending between the top wall and the bottom wall of the sole located within the toe area of the shoe, the fin plates being housed in an overlapping condition within the fin compartment in a retracted position; (iii) rotating, in an opposite direction, each of the fin plates toward the toe area of the shoe until the fin plates are in an abutting condition to form a swim fin to appointed the shoe for swimming; and (iv) disengaging the swim fin when exiting the water by pivoting each of the fin plates away from one another and inserting the fin plates through the elongated lateral fin opening into the fin compartment longitudinally integrated within the sole in an overlapping condition to prepare the shoe for walking.

BRIEF DESCRIPTION OF DRAWINGS

The invention will be more fully understood and further advantages will become apparent when reference is had to the following detailed description and the accompanying drawings, in which.

DESCRIPTION OF THE PREFERRED EMBODIMENTS

This invention relates to an amphibious shoe having a lightweight fin portion internally integrated therein for immediate access for conversion from a walking shoe to a swimming shoe. The amphibious shoe is further provided with enhanced stabilizing means integrated therein for superior operation of the fin and stabilization of the shoe during swimming as water is propelled to-and-fro against the fin. The amphibious shoe provides a shoe capable of being worn to the beach or water's edge that provides a fin readily accessible with the simple activation of a button or pulling of a tab. In operation of the amphibious shoe, the wearer can comfortably run or walk swiftly along the land and across the beach to a location near or in the water as the fin integrated within the shoe is lightweight and thin in construct so that it is not readily felt by the wearer's foot. Accordingly, the amphibious shoe's construction functions to require minimal manipulation of the shoe, so that the wearer does not have to remove the shoe or carry any obtuse fin parts. Retraction of the fin allows immediate use of the fin, while at the same time the amphibious shoe provides a stabilizing strap assembly for enhanced operation of the fin during swimming in steadying the fin and shoe on the wearer's foot as water is propelled to-and-fro against the fin. As a result, the amphibious shoe stays on the wearer's foot and the fin does not deform or otherwise bend as water forces are applied to the fin during swimming.

Figure 1A:
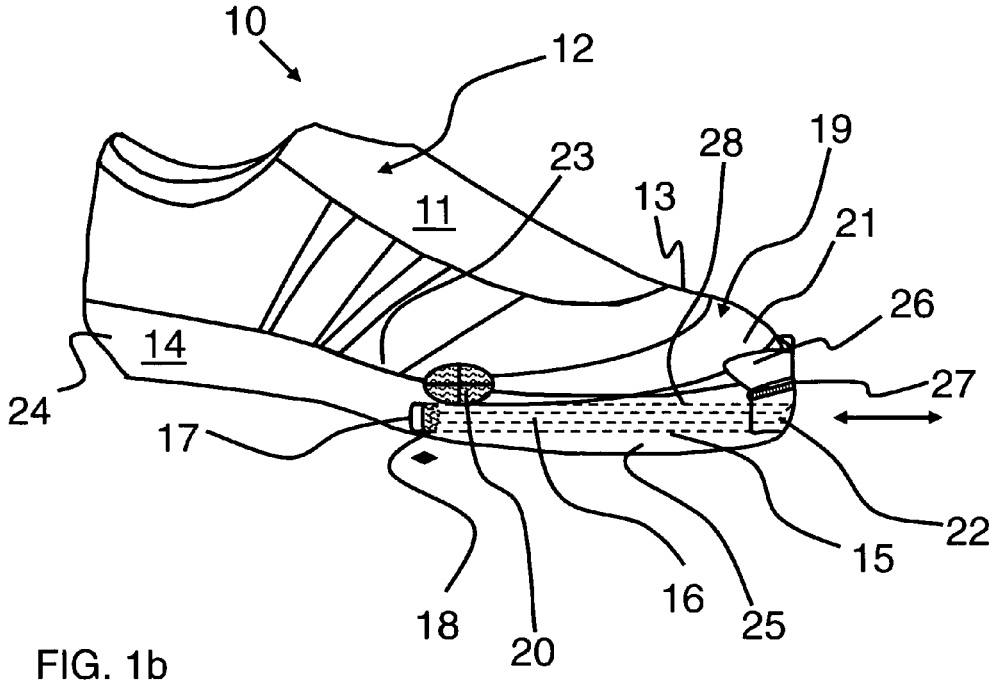
FIG. 1*a* is a top side view of an embodiment of the amphibious water shoe wherein the shoe is a mesh water shoe or sneaker and a fin is in the retracted position housed in a compact configuration within a fin compartment in the shoe's sole.
Figure 1B:
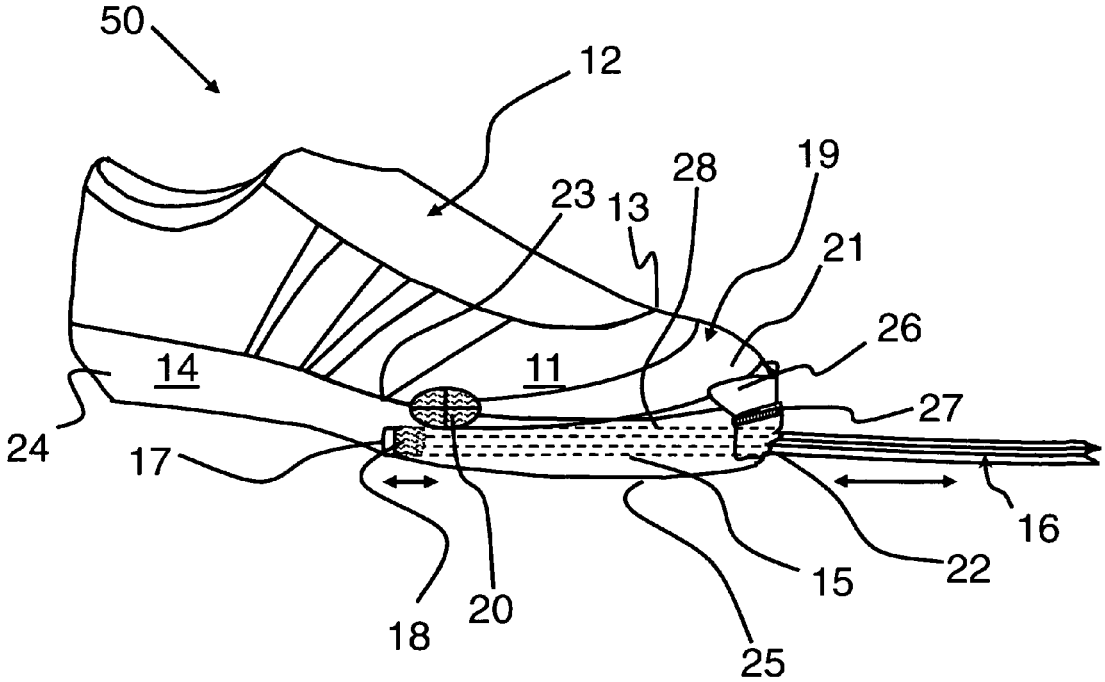
FIG. 1*b* shows a top side view wherein the fin is in the ejected position and in the compact configuration.
Figure 1C:
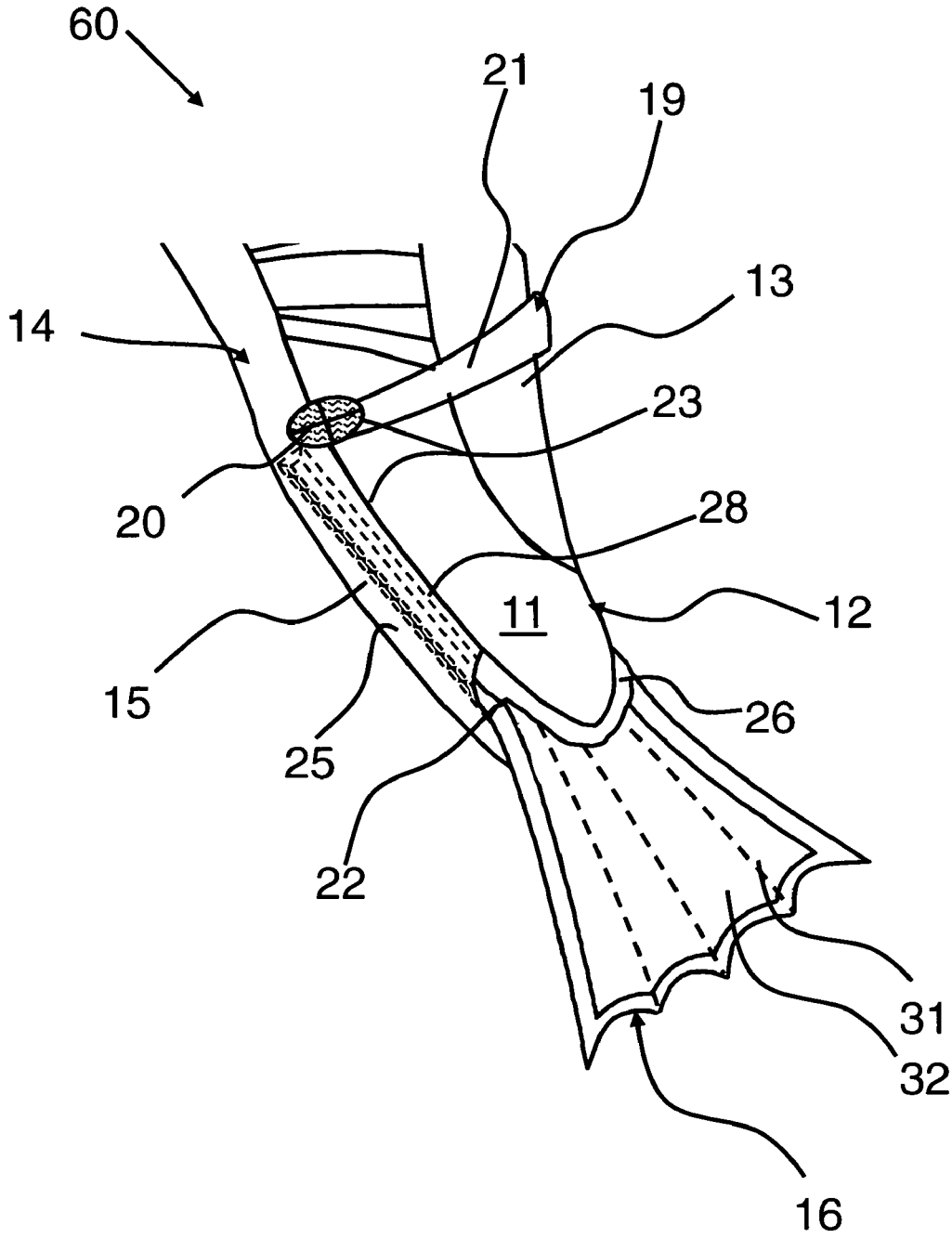
FIG. 1*c* shows a top side view wherein the fin is in the ejected position and in the fan configuration.

FIGS. 1*a*-1*c* illustrate a first embodiment of the amphibious shoe wherein the shoe is of a slip on shoe/sandal having a generally mesh construct typical of those worn in the water. Particularly: FIG. 1*a* illustrates a top side view wherein the fin is in the retracted position being housed within the fin compartment of the sole, shown generally at 10; FIG. 1*b* illustrates a top side view wherein the fin is in the ejected position and in the compact configuration, shown generally at 50; and FIG. 1*c* illustrates a top side view wherein the fin is in the ejected position and in the fan configuration, shown generally at 60. Amphibious shoe 11 comprises a shoe 12, herein shown as a mesh shoe that is typically worn in the water by swimmers, but may be of any type of shoe, sneaker, or sandal. Shoe 12 includes a shoe housing 13, herein shown as a top of a shoe and arch and heel portions, and a sole 14 constructed with a fin aperture 22, top wall 23, back wall 24, and a bottom wall 25 constructed to form a fin compartment 15 integrated therein. Fin aperture 22 may further include a aperture cover 26, which is preferably pivotally attached to fin aperture 22 by way of a hinge 27 or thin flexible strip so that aperture cover 26 can be opened to access fin aperture 22 when getting ready for ejecting a fin 16 housed within fin compartment 15 and closed to prevent debris and sand from entering fin aperture 22 when walking. Fin 16 is housed within fin compartment 15 in sole 14 in a retracted position. Fin 16 is associated with a release button 17 in communication with a spring tension 18 that forces a portion of fin 16 from sole 14 through said fin aperture 22 in an ejected position as shown in FIG. 1*b* and 1*c*.

Fin 16 comprises ridges 31 intermittent between a material 32 and arranged in an accordion construction so that fin 16 is capable of being extended to a fan configuration as shown in FIG. 1*c* when fin 16 is appointed to be utilized in water. Conversely, fin 16 is compressed to a compact configuration shown in FIG. 1*b* when fin 16 is appointed to be retracted back through fin aperture 22 into fin compartment 15 in sole 14. Ridges 31 are preferably composed of metal, but may be composed of a polymeric material. Ridges 31 preferably have a thickness ranging from 0.02 inches to 0.25 inches. Material 32 is preferably a lightweight mesh material. Alternatively, material 32 is composed of a lightweight thin rubber sheet material. The plurality of ridges 31 provides strength and rigidity to fin 16. Material 32 between ridges 31 is a lightweight mesh material.

Sole 14 is constructed slightly thicker than a typical sole for accommodation of fin 16. Sole 14 of shoe 12 preferably has a thickness ranging from 0.25 inches to 3 inches for accommodating fin 16. Sole 14 may include a transitional cushion 28 located within top wall 23 of sole 14 above fin compartment 15 to further enhance comfort to the wearer's foot by mitigating the ability of the wearer to feel the fin 16 when walking or running. Transitional cushion 28 may be composed of a memory foam, foam, fibrous cushion, or gel like cushion. When release button 17, located on the side of the shoe, is depressed it communicates with spring tension 18, so fin 16 automatically extends outwardly; and then expands to form the flipper or fan configuration.

A pivotal stabilizing strap assembly 19 is attached at the front of shoe 12 appointed for holding fin 16 in place on a wearer's foot and operates to pivot and rest against the wearer's foot to provide enhanced stability of fin 16 and shoe 12 during swimming. In one embodiment, pivotal stabilizing strap assembly 19 includes a pivot bolt 20 attached to shoe housing 13 and a pivoting strap 21 so that pivotal stabilization strap assembly 19 is pivotally attached to a front portion of shoe 12, up near the toe region, and operates to pivot and rest against a top part of the wearer's foot. In operation, strap 21 pivots back toward the person's ankle or top bridge of the foot. A lock member is provided on pivot bolt 20 to lock strap 21 in place on the top of the foot. Preferably, pivotal stabilization strap assembly 21 comprises a tension mechanism. The tension mechanism may be a locking mechanism, such as a tension buckle, or preferably may be provided by composing strap 21 of an elastic band material and appointing an adjustment buckle thereon, so that after strap 21 is pivoted to rest on the bridge of the foot it is tightened by way of the adjustment buckle. Strap 21 may be a soft polymeric material and may have a concave shape to mirror the top bridge of the foot so that it snuggly hugs the top bridge of the foot when resting thereon and locked via locking mechanism means (such as locking fasteners or the like). In an alternative embodiment, the pivotal stabilization strap assembly may be longer and flexible for stretching behind the person's heels (see discussion in FIG. 2).

Figure 2A:
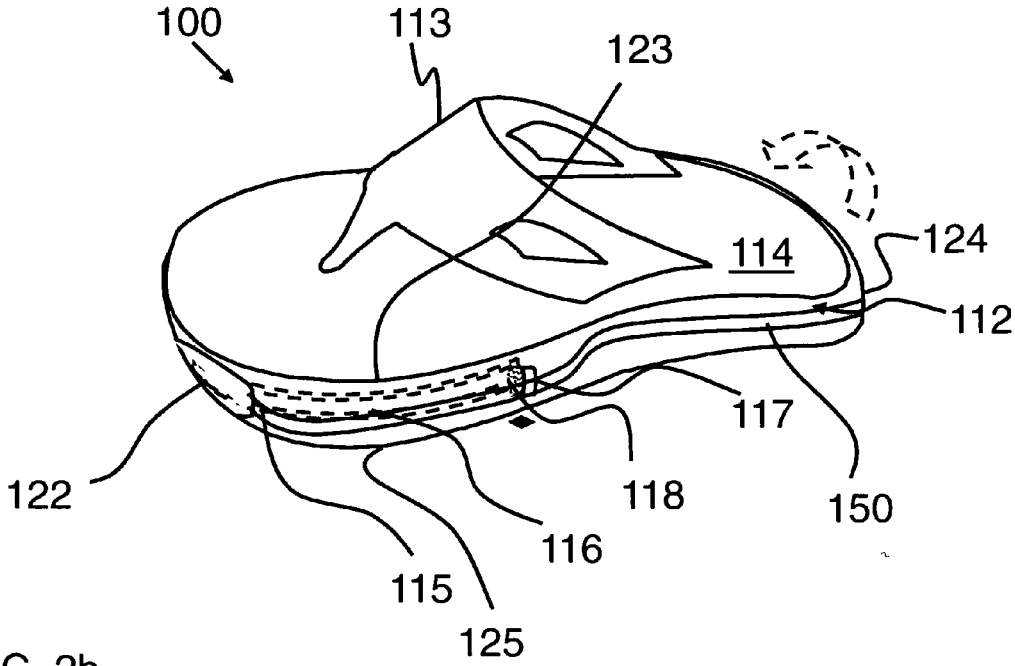
FIG. 2*a* shows a top view of another embodiment of the amphibious water shoe wherein the shoe is of a sandal or flip-flop and wherein stabilization means is provided as a fin strap.
Figure 2B:
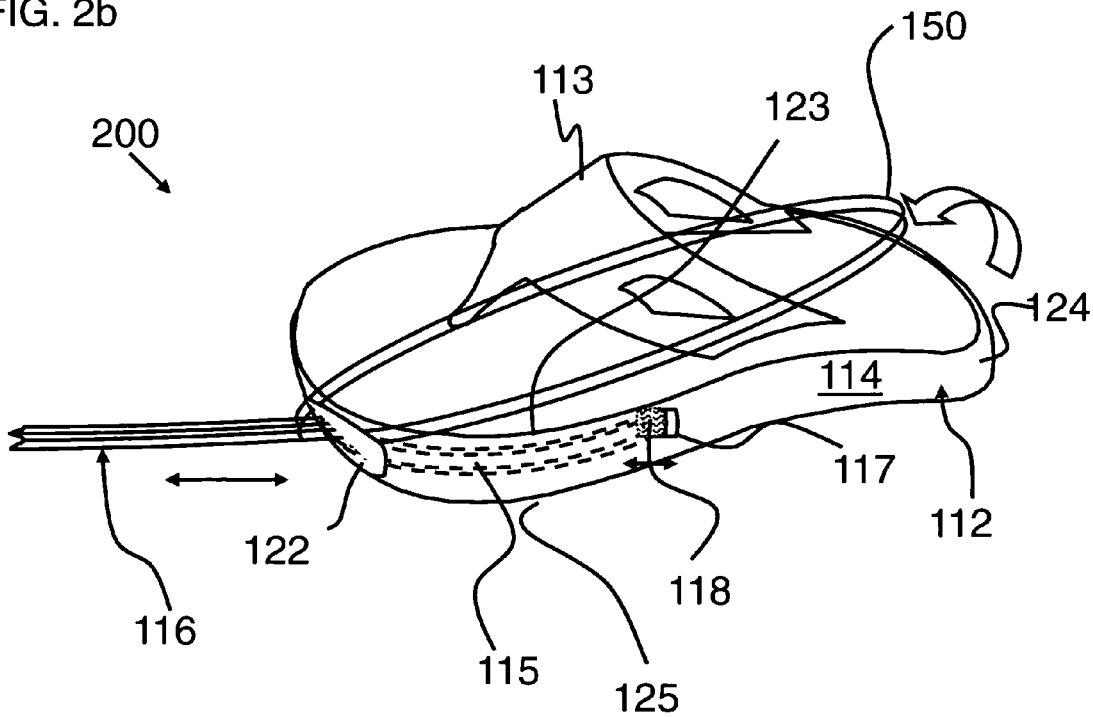
FIG. 2*b* shows a top side view wherein the fin is in the ejected position and in the compact configuration.
Figure 2C:
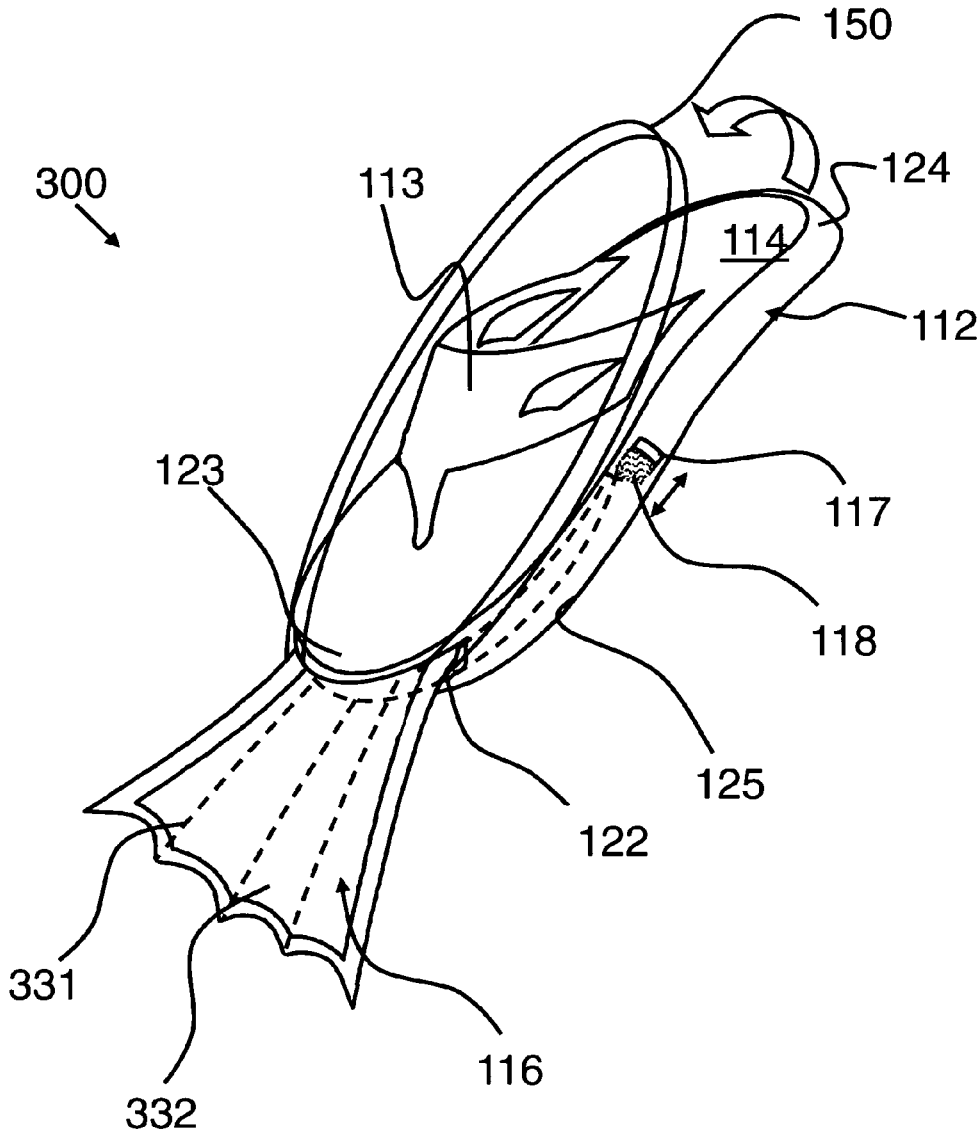
FIG. 2*c* shows a top side view wherein the fin is in the ejected position and in the fan configuration.

FIGS. 2*a*-2*c* illustrate a similar embodiment of the amphibious shoe as shown in FIG. 1*a*-1*c*, however, herein the shoe is of a sandal or flip-flop and the pivotal stabilization strap assembly is shown in an alternative embodiment wherein it is attached to a front portion of the shoe and extends around a peripheral of the sole so that the pivotal stabilization strap is rotated upward to rest behind a heel of the wearer's foot. Particularly: FIG. 2*a* illustrates a top side view wherein the fin is in the retracted position being housed within the fin compartment of the sole, shown generally at 100; FIG. 2*b* illustrates a top side view wherein the fin is in the ejected position and in the compact configuration, shown generally at 200; and FIG. 2*c* illustrates a top side view wherein the fin is in the ejected position and in the fan configuration, shown generally at 300. Amphibious shoe 111 comprises a shoe 112, herein shown as a sandal/flip-flop, with a shoe housing structure 113, herein shown as a strap, and a sole 114 constructed with a fin aperture 122, top wall 123, back wall 124, and a bottom wall 125 constructed to form a fin compartment 115 integrated therein housing a fin 116 in a retracted position. Fin 116 is associated with a release button 117 in communication with a spring tension 118 and comprises ridges 331 intermittent between a material 332 arranged in an accordion construction so that fin 116 is capable of being expanded to a fan configuration as shown in FIG. 2*c* and compressed to a compact position as shown in FIG. 2*b* and 2*a*. A pivotal stabilization strap assembly 150 is pivotally attached to a front portion of shoe 112 and extends around a peripheral of sole 114 so that pivotal stabilization strap 150 is rotated upward to rest behind a heel of the wearer's foot. Stabilization strap 150 is appointed for holding fin 116 in place on a wearer's foot behind the heel, thereby anchoring the shoe securely on the foot. Pivotal stabilization strap assembly 150 is preferably composed of an elastic strap or band with a tension setting buckle for tension adjustment behind the heel of the wearer's foot. Pivotal stabilization strap assembly 150 is attached to sole 114 proximal to fin aperture 122 to fully anchor shoe 112 on the wearer's foot by fully leveraging fin 116 on shoe 112 as against the wearer's heel.

Figure 3A:
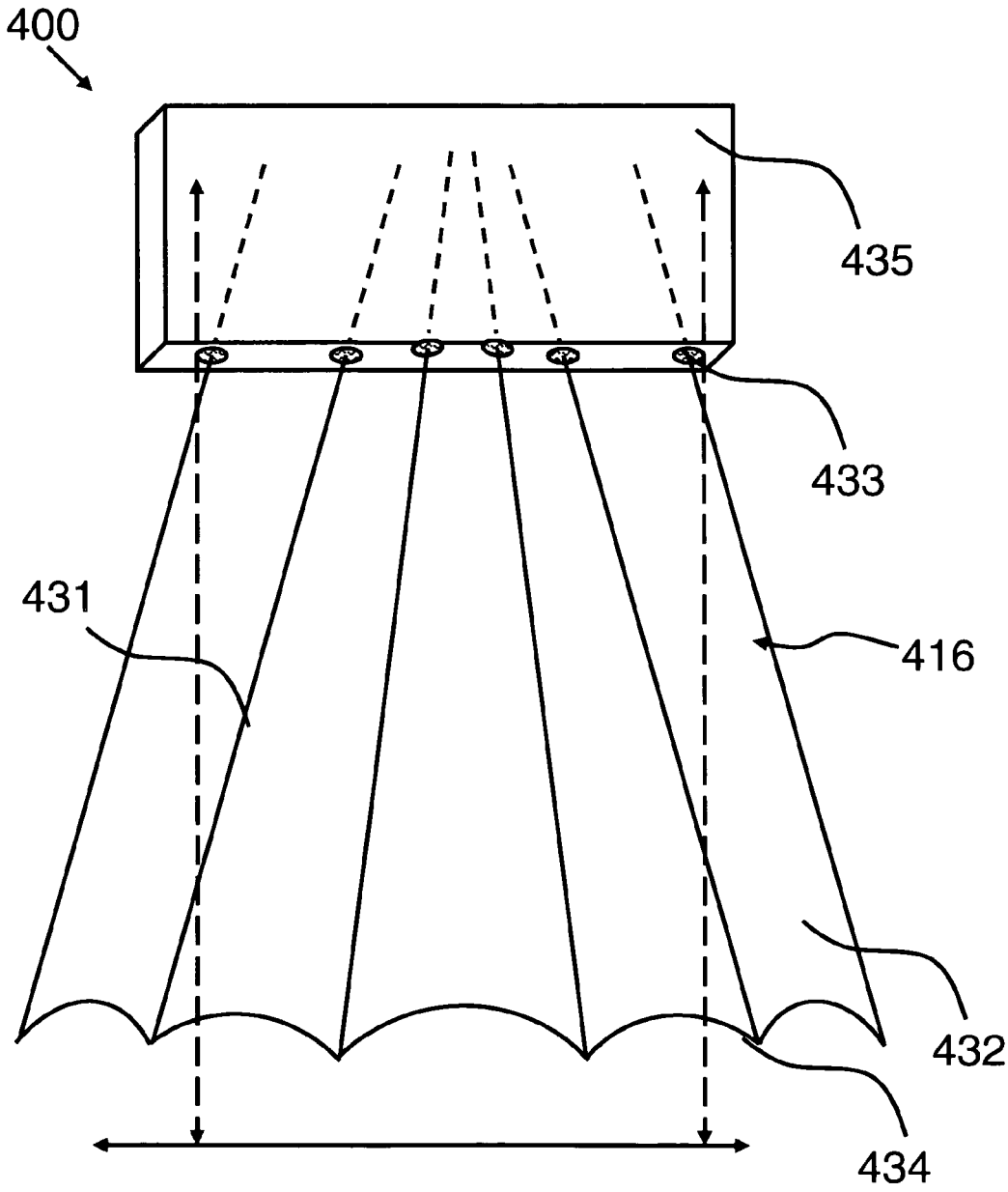
FIG. 3*a* is a top view of an embodiment of the fin.
Figure 3B:
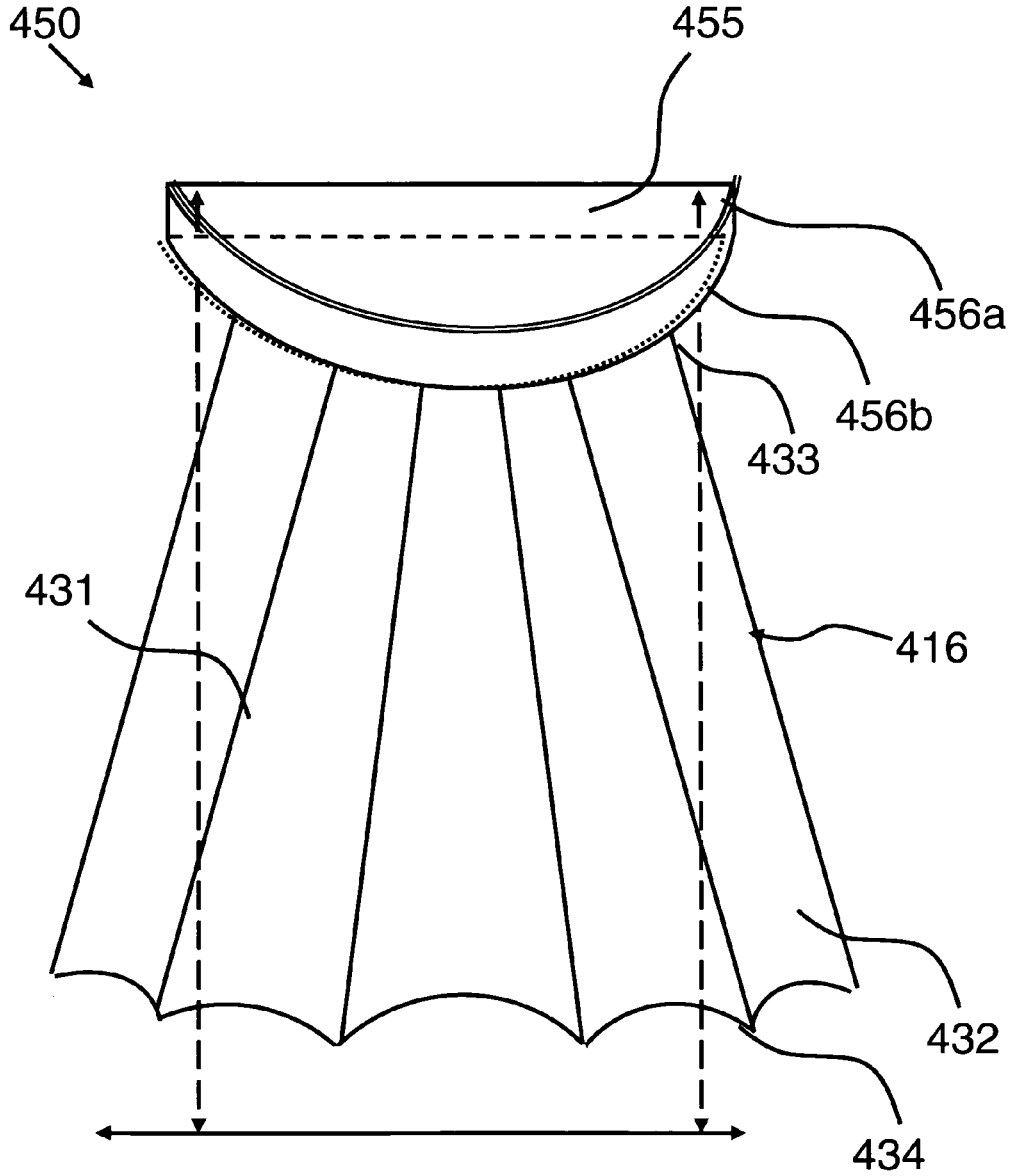
FIG. 3*b* is a top view of another embodiment of the fin.

FIGS. 3*a* and 3*b* illustrate perspective views of the fin of the amphibious shoe, shown generally at 400, and 450, respectively. Fin 416 is comprised of a flexible mesh material 432 located between ridges 431. Ridges 431 include a proximal end 433 and a distal end 434. Proximal end 433 traverses into block 435 (FIG. 3*a*)/arced block 455 (FIG. 3*b*). Ridges 431 operate to automatically expand or fan out, when block 435/arced block 455 moves forward within the fin compartment to release fin 416 therefrom. In FIG. 3*b*, arced block 455 has the shape and contour of the front of the shoe (i.e. toe area) for a flush configuration with the fin aperture so that water entry into the fin compartment during swimming is mitigated. Block 455 may include a rubber gasket 456 (456*a* on a top rim of block 455 and 456*b* on a bottom rim of block 455) to further provide a substantially water tight fin compartment during swimming.

Figure 4A:
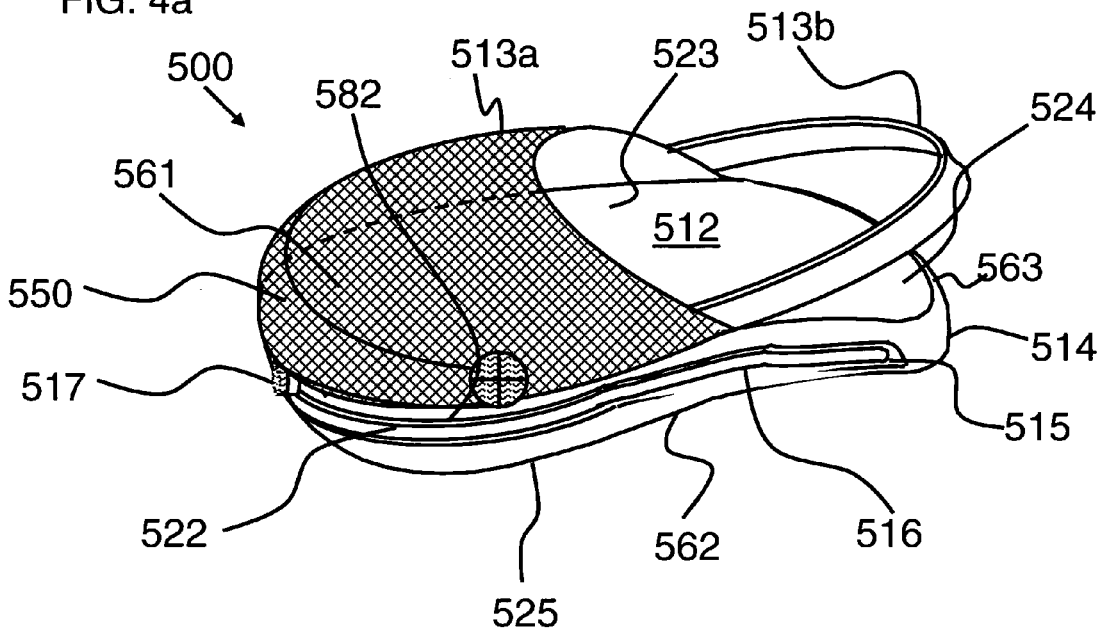
FIG. 4*a* illustrates a top-side view of another embodiment of the amphibious water shoe wherein the shoe/sandal or flip-flop comprises at least two fin plates housed within a fin compartment in the sole of the shoe, which pivotally rotate from the sole of the shoe to join to form a fin.
Figure 4B:
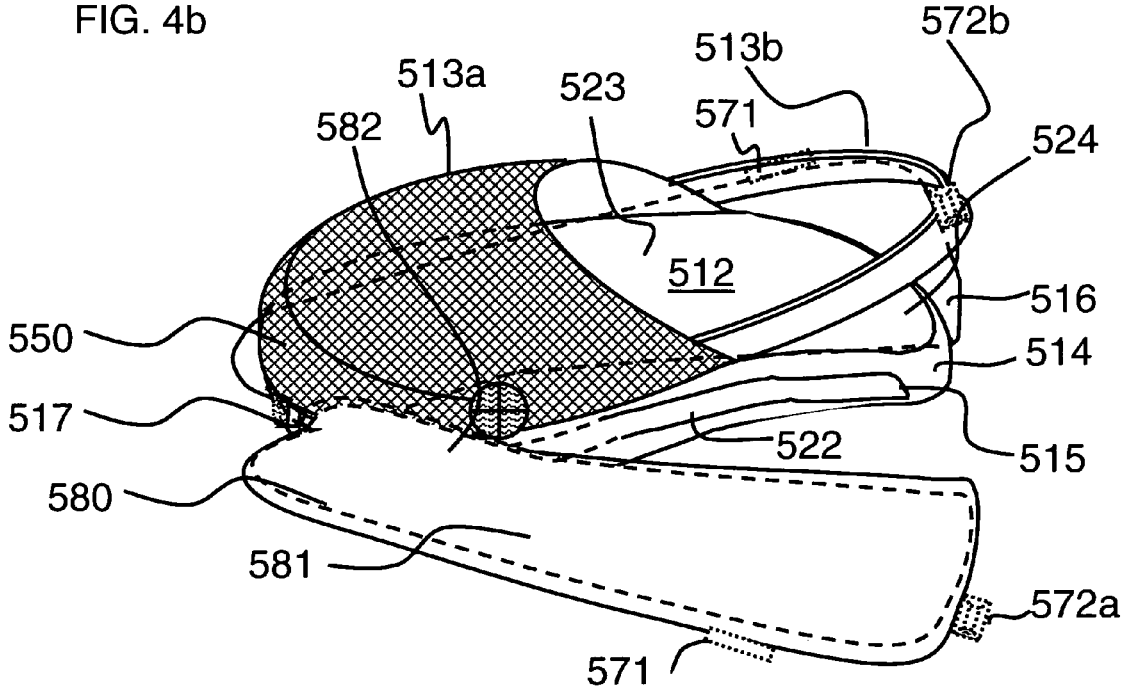
FIG. 4*b* illustrates a top side view wherein the fin plates are becoming ejected.
Figure 4C:
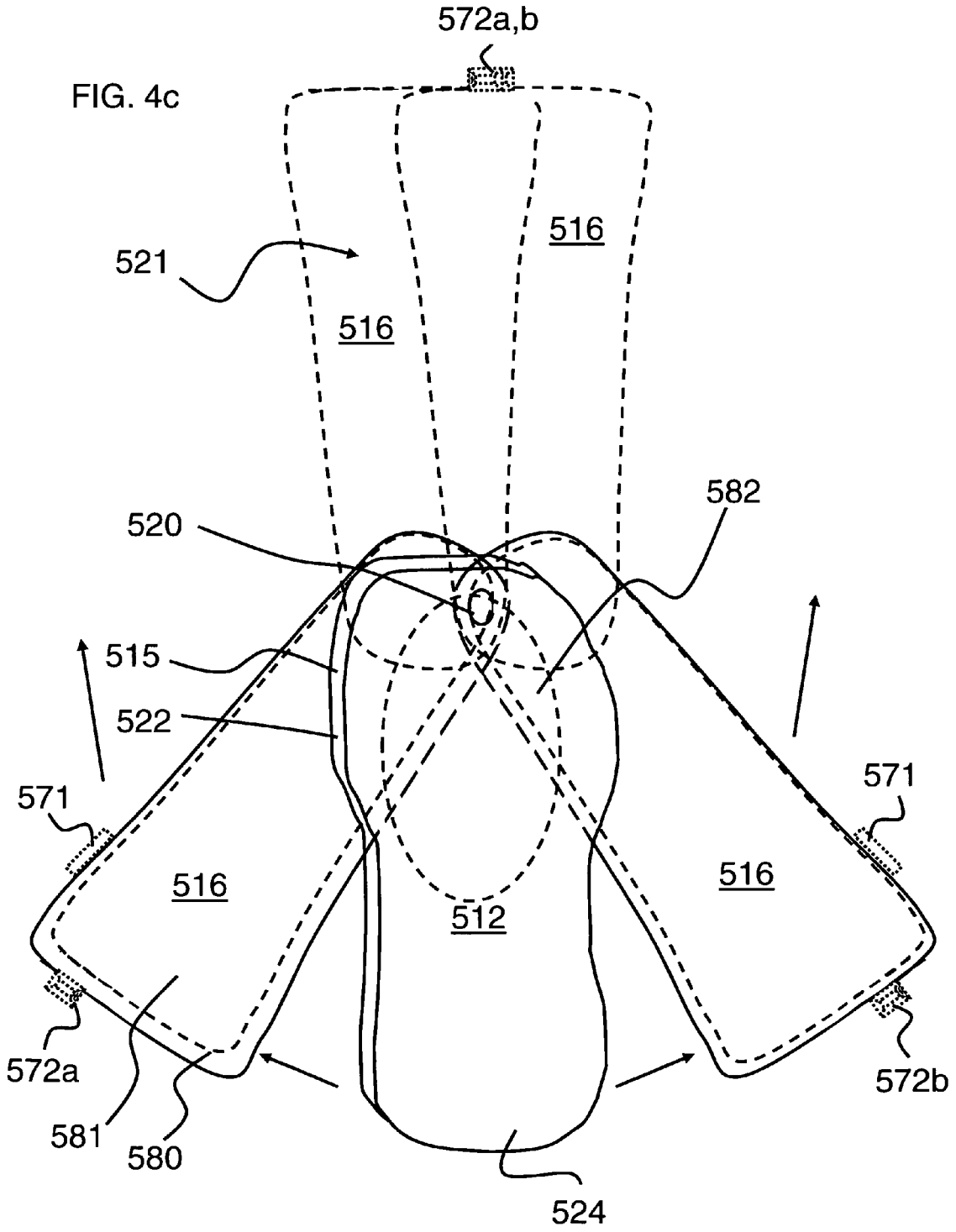
FIG. 4*c* illustrates a bottom view wherein the fin plates are in the ejected position and in the fan configuration (shown in the phantom).

FIGS. 4*a*-4*c* illustrate an embodiment of the amphibious shoe wherein the shoe/sandal or flip-flop comprises at least two fin plates which retract from the shoe, shown generally at 500. Particularly: FIG. 4*a* illustrates a top side view wherein the fin plates are in the retracted position being housed within the fin compartment of the sole, shown generally at 500; FIG. 4*b* illustrates a top side view wherein the fin plates are becoming ejected; and FIG. 4*c* illustrates a bottom view wherein the fin plates are in the ejected position and in the fan configuration (shown in the phantom).

Amphibious shoe 500 comprises a shoe 512, herein shown as a sandal/flip-flop, with a shoe housing structure 513*a* for toes and strap 513*b* for the heel, and a sole 514 integrated with a fin compartment 515 housing at least two fin plates 516 in a retracted rotatable position. Shoe 512 is appointed with a front toe area 561, arch area 562, and a heel area 563. Sole 514 includes an elongated lateral fin opening 522, top wall 523, back wall 524, and a bottom wall 525 constructed to form fin compartment 515 longitudinally integrated therein. Fin plates 516 are preferably associated with a release button 517 in communication with a spring tension, which is shown on the front of shoe 512, but may be anywhere associated on the body of sole 514, that forces a portion of each of fin plates 516 from 5 fin compartment 515 through elongated lateral fin opening 522 in an ejected position. Alternatively, ejection of fin plates 516 can be achieved manually by way of pulling on opposing lateral release tabs (shown in phantom at 571 in FIGS. 4*b* and 4*c*) located on fin plates 516 appointed to be pulled upon for rotating fin plates 516 from elongated lateral fin opening 522. Fin plates 516 may include mating locking tabs (572*a* and 572*b* shown in phantom in FIGS. 4*b* and 4*c*) appointed to lock fin plates 516 together when forming swim fin 521.

These fin plates 516 may be composed of a durably lightweight mesh material, or may be composed of a semi-rigid polymeric material. Preferably, fin plates 516 comprise ridges intermittent between a mesh material for light weight construction. Fin plates 516 may comprise an outer ridge perimeter 580 with a material sheet 581 integrated and extending therein. Material sheet 581 may be composed of a mesh material. Alternatively, material sheet 581 is composed of a thin rubber material (see FIGS. 4*b* and 4*c*).

Fin plates 516 are arranged in an overlapping configuration while in fin compartment 515, and rotate about a pivot joint/axis 520 extending upward between top wall 223 and bottom wall 525 of sole 514 under toe area 561 of shoe 512. Fin plates 516 are housed in an overlapping condition within fin compartment 515 in a retracted position and are appointed to opposing pivot (see FIG. 4*c*) and rotate through elongated lateral fin opening 522 toward toe area 561 of shoe 512 until they abut to form a swim fin 521 (see FIG. 4*c* in phantom). Upon exiting fin compartment 515 fin plates 516 each oppositely rotate 180 degrees to join or abut at the front of the shoe to form the expanded fin 521 (shown in phantom). Sole 514 of shoe 512 preferably has a thickness ranging from 0.6 inches to 3 inches for providing comfort during walking. Elongated lateral fin opening 522 located within sole 514 preferably has height ranging from 0.20 inches to 2 inches for providing adequate space therein for fin plates 516. Fin plates 516 preferably have a thickness ranging from 0.10 inches to 1.8 inches to provide a thin, lightweight construction. Sole 514 of shoe 512 may further comprise a transitional cushion 582 located within top wall 523 of sole 514 above fin compartment 515. A pivotal stabilizing strap assembly 550 may be provided appointed for holding swim fin 521 in place on a wearer's foot that operates to pivot and rest against the wearer's foot to provide enhanced stability of swim fin 521 and shoe 512 during swimming.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. An amphibious shoe, comprising:

a. a shoe appointed with a front toe area, arch area, and a heel area, said shoe having a sole including an elongated lateral fin opening, top wall, back wall, and a bottom wall constructed to form a fin compartment longitudinally integrated therein; and b. at least two fin plates attached by way of a pivot joint extending between said top wall and said bottom wall of said sole located within said toe area of said shoe, said fin plates being housed in an overlapping condition within said fin compartment in a retracted position and being appointed to opposing pivot and rotate through said elongated lateral fin opening toward said toe area of said shoe until they abut to form a swim fin.

2. An amphibious shoe as recited by claim 1, wherein said fin plates are associated with a release button in communication with a spring that forces a portion of each of said fin plates from said fin compartment through said elongated lateral fin opening of said sole in an ejected position.

3. An amphibious shoe as recited by claim 1, wherein each of said fin plates include opposing lateral release tabs appointed to be pulled upon for rotating each of said fin plates from said elongated lateral fin opening of said sole in an ejected position.

4. An amphibious shoe as recited by claim 1, wherein each of said fin plates include mating locking tabs appointed to lock said fin plates together when forming said swim fin.

5. An amphibious shoe as recited by claim 1, wherein said fin plates comprise an outer ridge perimeter with a material sheet integrated and extending therein.

6. An amphibious shoe as recited by claim 5, wherein said material sheet is composed of a mesh material.

7. An amphibious shoe as recited by claim 5, wherein said material sheet is composed of a thin rubber material.

8. An amphibious shoe as recited by claim 1 comprising a pivotal stabilizing strap assembly appointed for holding said fin in place on a wearer's foot that operates to pivot and rest against said wearer's foot to provide enhanced stability of said fin and said shoe during swimming.

9. An amphibious shoe as recited by claim 1, wherein said sole of said shoe has a thickness ranging from 0.6 inches to 3 inches.

10. An amphibious shoe as recited by claim 1, wherein said elongated lateral fin opening located within said sole of said shoe has height ranging from 0.20 inches to 2 inches.

11. An amphibious shoe as recited by claim 1, wherein said fin plates have a thickness ranging from 0.10 inches to 1.8 inches.

12. An amphibious shoe as recited by claim 1, wherein said sole of said shoe comprises a transitional cushion located within said top wall of said sole above said fin compartment.

13. A method of using an amphibious shoe, comprising steps of:

a. wearing a shoe appointed with a front toe area, arch area, and a heel area, said shoe having a sole including an elongated lateral fin opening, top wall, back wall, and a bottom wall constructed to form a fin compartment longitudinally integrated therein;

b. adjusting said shoe for swimming by rotating at least two fin plates from said fin compartment longitudinally integrated within said sole through said elongated lateral fin opening, said fin plates being attached by way of a pivot joint extending between said top wall and said bottom wall of said sole located within said toe area of said shoe, said fin plates being housed in an overlapping condition within said fin compartment in a retracted position;

c. rotating, in an opposite direction, each of said fin plates toward said toe area of said shoe until said fin plates are in an abutting condition to form a swim fin to appointed said shoe for swimming; and d. disengaging said swim fin when exiting swimming by opposing pivoting each of said fin plates away from one another and inserting said fin plates through said elongated lateral fin opening into said fin compartment longitudinally integrated within said sole in an overlapping condition to appoint said shoe for walking.

* * * * *